United States Patent [19]

White

[11] Patent Number: 4,534,372

[45] Date of Patent: Aug. 13, 1985

[54] SMOKING PRODUCT

[75] Inventor: Jackie L. White, Pfafftown, N.C.

[73] Assignee: R. J. Reynolds Tobacco Company, Winston-Salem, N.C.

[21] Appl. No.: 525,056

[22] Filed: Aug. 22, 1983

[51] Int. Cl.[3] ..... A24B 15/18; A24B 15/22; A24D 1/18

[52] U.S. Cl. ..... 131/359; 131/352; 131/353; 131/354; 131/369; 131/371

[58] Field of Search ..... 131/352, 353, 354, 359, 131/369, 370, 371

[56] References Cited

U.S. PATENT DOCUMENTS 3,638,660 2/1972 Davis ..... 131/359
3,931,824 1/1976 Miano et al. ..... 131/359
3,964,494 6/1976 White ..... 131/359
3,964,495 6/1976 White ..... 131/359
3,964,496 6/1979 White ..... 131/359

FOREIGN PATENT DOCUMENTS 1553326 9/1979 United Kingdom ..... 131/359

*Primary Examiner*—V. Millin
*Attorney, Agent, or Firm*—Herbert J. Bluhm

[57] ABSTRACT

A combustible smoking material having a color other than that of conventionally cured tobacco leaves is coated with finely divided, toasted cereal grain to impart a tobacco-like brown color to the combustible smoking material.

16 Claims, No Drawings

SMOKING PRODUCT

TECHNICAL FIELD

This invention relates to the preparation of smoking products containing a combustible smoking material which is coated with a coloring agent that imparts a tobacco-like color to the material.

BACKGROUND ART

The prior art discloses a large number of combustible non-tobacco materials which have been proposed as substitutes for tobacco in the preparation of smoking products. Most of these materials do not have colors that are typical of tobacco. Consequently, it is usually desirable to add coloring agents to such materials to improve acceptance by smokers who are accustomed to tobacco-like colors associated with smoking products they consume.

Various coloring agents and techniques have been disclosed in the art for imparting tobacco-like colors to tobacco substitutes. For example, U.S. Pat. No. 3,638,660 discloses a tobacco substitute having appropriate dyes incorporated therein. U.S. Pat. No. 3,931,824 describes a cellulose-based tobacco substitute colored with agents such as carbon, iron oxide, food dyes, tobacco extracts, organic colorants and inorganic pigments. These agents are not entirely satisfactory because they may give rise to objectionable flavors upon smoking or they may be impractical due to economic considerations.

Another technique for coloring tobacco substitutes is described in British Pat. No. 1,553,326 wherein tobacco dust comprising particles of 75 microns or less in diameter is applied to the surface of previously shredded tobacco substitute material to impart a tobacco-like color thereto. While that technique is effective, it also tends to defeat the purpose of adopting tobacco substitutes, namely, the elimination of tobacco from smoking products.

Included in the various materials described in the art as suitable tobacco substitutes are a number of cereal grains. These cereal grains are disclosed in U.S. Pat. Nos. 3,964,494 through 3,964,498 and 3,977,412 through 3,977,415. They are usually treated to effect expansion of the kernels of grain and the expanded grain is then shredded and used directly as a suitable smoking material. The shredded, expanded grain typically consists of elongated strands which are compatible with cut tobacco used as filler in the manufacture of cigarettes. The shredded, expanded grain is preferably coated with tobacco dust as described in the above-mentioned British Pat. No. 1,553,326 in order to approximate the physical appearance of tobacco shreds.

BRIEF SUMMARY OF THE INVENTION

This invention provides an improved method for imparting a tobacco-like color to smokable materials by applying finely divided, toasted cereal grain material to the surface of the smokable materials or by incorporating the toasted material into a slurry of smokable materials that is subsequently shaped into desired form. By employing toasted cereal grain material as the coloring agent, it is possible to vary the degree of color imparted to the smokable materials by controlling the color developed by the cereal grain during the toasting process. Moreover, the cereal grain material itself is a combustible material that is very well suited to use as a tobacco substitute. Accordingly, this invention provides a surprising and unexpected versatility that is not anticipated by the prior art.

DETAILED DESCRIPTION OF THE INVENTION

The smoking products of this invention are typically based on carbohydrates such as cellulose and starch or materials consisting largely of cellulose or starch. The carbohydrates or carbohydrate-containing materials are subjected to a variety of treatments in connection with the preparation of smokable material therefrom. These treatments may be minimal and merely involve a change in the physical shape of the carbohydrate-containing material or they may be extensive and involve chemical and/or thermal degradation of the carbohydrate-containing material. The treatments frequently include addition of inorganic salts, binders, flavorants and other agents designed to produce a material that has satisfactory combustion and smoking properties. Thus, various treatments may lead to a smokable material that is white, gray, black, etc. depending on the starting materials, the treatment(s) applied and the additives introduced.

In one embodiment of the present invention a combustible smokable material is cut, shredded or otherwise comminuted to give the particle size desired for the smoking product in which it is to be used. The surface of the comminuted smoking material is moistened and/or treated with an adhesive agent and is then coated with a quantity of finely divided, toasted cereal grain (described below) sufficient to impart a tobacco-like color to the smoking material. The finely divided, toasted cereal grain may be applied to the comminuted smoking material by the procedures described in British Pat. No. 1,553,326 the teachings of which are incorporated herein by reference. In those instances where the combustible smoking material is prepared in the form of a continuous web, the finely divided, toasted cereal grain may be applied to the surface of the web in an analogous manner after the web has been moistened and/or treated with an adhesive agent. In either case it is important that the combustible smoking material having the finely divided, toasted cereal grain applied to the surface thereof be gently agitated or subjected to other suitable treatment which promotes distribution of the cereal grain across the entire surface of the smoking material.

A number of cereal grains may be used for preparing the finely divided, toasted material that is used in connection with the present invention. The cereal grains disclosed in U.S. Pat. Nos. 3,964,494 through 3,964,498 and 3,977,412 through 3,977,415 provide generally satisfactory results and particularly preferred are milo and corn. The term "cereal grain" as used herein is intended to refer to the kernels of seed of the respective plants rather than the leaves, stem or other parts of the plant. In adapting the cereal grain for use in this invention, the grain is preferably subjected to treatment known in the art for puffing or expanding the grain. The puffed or expanded grain is then cut, shredded or otherwise comminuted in a manner similar to that disclosed in the abovementioned U.S. patents. The resulting coarse particles of grain are then heated at elevated temperatures for a period of time sufficient to toast the particles and cause them to turn brown in color. This toasting operation may be conveniently accomplished by arranging a 0.5-cm to 5.0-cm. thick layer of the comminuted grain particles in an oven that is maintained at temperatures of approximately 190° C. to 210° C. The time required for toasting the grain particles will depend on the shade of brown color that is desired, the depth of the layer of grain particles, the oven temperature and the particular variety of grain employed. Generally, however, heating periods of 2 to 4 hours are sufficient to produce a brown color which compares very closely with typical brown colors associated with cured tobacco leaves.

The dry, toasted cereal grain is milled to give particle sizes which are suitable for applying to the combustible smoking material. Apparatus for milling the toasted cereal grain is commercially available and includes, for example, a ceramic ball mill such as the DM-3C SWECO Vibro-Energy Dry Grinding Mill manufactured by SWECO Inc. of Los Angeles, Calif. The milling procedure is continued until the maximum diameter of the milled particles is approximately 30 microns and, preferably, 10 microns or less.

Treatment of the combustible smoking material prior to application of finely divided, toasted cereal grain to the surface thereof involves moistening the surface and optionally applying suitable adhesive agents thereto. The combustible smoking materials are typically maintained at moisture levels of 8 to 20 percent while they are being processed for use in the manufacture of smoking products. Aqueous media are used to moisten the surface of the smoking material and the quantities of such media required will be determined by their composition and the moisture content of the smoking material being moistened. It is preferred that between 10 and 50 parts by weight of the desired aqueous medium be applied to each 100 parts by weight of the smoking material being moistened. Although greater proportions of the aqueous medium can be employed (e.g., equal parts of aqueous medium and smoking material), it is usually not advantageous to do so because the excess moisture must be subsequently removed from the treated smoking material before it can be used in the manufacture of smoking products. Appropriate humectant agents such as glycerol and propylene glycol are preferably included in the aqueous media and may constitute up to 25 percent by weight of the aqueous media. When adhesive agents are included in the aqueous media, they are preferably derived from carbohydrates such as starch, cellulose and sucrose (e.g., dextrins, corn syrup, carboxymethylcellulose and invert sugar) and constitute up to 50 percent by weight of the aqueous media.

The quantity of finely divided, toasted cereal grain required to impart a tobacco-like color to the combustible smoking material will depend on a number of factors including the initial color and surface texture of the combustible smoking material, the particle size and color of the finely divided cereal grain and the quantity of aqueous medium used to moisten the surface of the smoking material. Generally, the quantity of finely divided, toasted cereal grain applied to the combustible smoking material should be at least 20 percent by weight and, preferably, 30 percent by weight based on the dry weight of the smoking material. The dry weight of the smoking material is defined as the residual weight of the material after it has been heated for 15 minutes in an oven that is maintained at 124° C. and excludes the weight of relatively non-volatile additives such as humectants and casing materials which may have been previously applied to the smoking material.

Following application of the finely divided, toasted cereal grain to the surface of the combustible smoking material, the moisture content of the treated smoking material is adjusted, if necessary, to a level of approximately 11 to 14 percent and the coated smoking material is used in the manufacture of smoking products such as smoking tobacco and cigarettes by carefully blending the coated smoking material with the tobacco being processed. The resulting blend or mixture may contain up to 50 percent by weight of the coated smoking material.

The following examples will further illustrate the manner in which this invention may be practiced.

EXAMPLE 1

Milo (*Sorghum vulgare*) is processed by procedures and apparatus known in the art for expanding the volume of the milo to produce puffed or expanded milo. The expanded milo is shredded and placed in a shallow, metal pan to give a bed depth of approximately 5 cm. The metal pan containing the milo is placed in an oven that is maintained at 190°–210° C. A heating period of 3 hours with occasional stirring of the bed of shredded milo causes the shredded milo to become toasted and brown in color. The toasted milo is milled in a DM-3C SWECO ceramic ball mill to a particle size of approximately 10 microns. The moisture content of the milled, toasted milo is approximately 2 percent and its bulk density is approximately 0.37 gram per cubic centimeter.

EXAMPLE 2

Corn (*Zea mays*) is expanded by procedures and apparatus known in the art. The expanded corn is shredded and placed in a shallow, metal pan to a bed depth of approximately 5 cm. The pan containing the shredded, expanded corn is heated in an oven maintained at 190°–210° C. for 3 hours with occasional stirring of the bed of shredded corn. The resulting toasted corn, which is brown in color, is milled in a DM-3C SWECO ceramic ball mill until the average particle size is approximately 10 microns. The moisture content of the milled, toasted corn is approximately 2 percent.

EXAMPLE 3

Rice (*Oryza sativa*) is processed by procedures and apparatus known in the art for expanding its volume. The expanded or puffed rice is shredded and placed in a shallow, metal pan to a bed depth of about 5 cm. The metal pan containing the rice is placed in an oven that is maintained at 190°–210° C. The pan containing the shredded rice is heated for 3 hours with occasional stirring of the bed of shredded rice to give a toasted, shredded rice that is brown in color. The resulting toasted rice is milled in a DM-3C SWECO ceramic ball mill to a particle size of about 10 microns. The moisture content of the milled, toasted rice is approximately 2 percent.

EXAMPLE 4

A combustible smoking material is prepared by subjecting flue cured tobacco stems to pyrolysis in a nitrogen atmosphere. The stems are gradually heated in an oven over a period of 2 to 3 hours to a temperature of 650° C. and maintained at that temperature for 1 hour before allowing the oven and stems to cool gradually to ambient temperatures. The pyrolyzed stems (one part by weight) are placed in two parts by weight water and milled in a Model 504 Morehouse mill available from Morehouse-Cowles, Inc. of Los Angeles, Calif., until the maximum particle size is less than 100 microns. The resulting aqueous slurry containing 200 g. of pyrolyzed stem material is combined with 18 grams of sodium carboxymethylcellulose, 10 grams of guar gum and additional water to give a thick paste when thoroughly blended with a Hobart HCM-450 cutter/mixer available from Hobart Corporation of Troy, Ohio. The paste is formed into a sheet and dried to a moisture content of about 8 percent. The thickness of the dried sheet, which is black in color, is about 0.4 mm. The moisture content of the dried sheet is readjusted to about 16 percent and the sheet is then shredded to give a cut filler suitable for use in manufacturing cigarettes. The cut filler (200 g.) is tumbled in an inclined rotating drum and sprayed with an aqueous solution comprising 50 grams of invert sugar (75% solids), 20 grams of water, 2 grams of propylene glycol and 15 grams of glycerol. With continued tumbling of the moistened and adhesive-coated cut filler, 100 grams of finely divided, toasted milo prepared by the procedure of Example 1 is sprinkled onto the tumbling cut filler. The toasted milo is uniformly distributed on the surface of the cut filler to impart an excellent tobacco-like brown color to the inherently black cut filler. The cut filler coated with the milled, toasted milo is carefully blended with equal parts by weight of cut tobacco and is made into cigarettes. The cigarettes exhibit acceptable smoking characteristics with reduced levels of nicotine in the smoke when compared with cigarettes containing tobacco only.

EXAMPLE 5

A cut filler (200 g.) prepared from pyrolyzed tobacco stems as described in Example 4 is sprayed with an aqueous solution comprising 50 grams of invert sugar (75% solids), 20 grams of water and 2 grams of propylene glycol while the cut filler is tumbled in an inclined rotating drum. With continued tumbling of the moistened and adhesive-coated cut filler, 100 grams of finely divided, toasted corn prepared by the procedure of Example 2 is sprinkled onto the tumbling cut filler. The toasted corn is uniformly distributed on the surface of the cut filler to impart a pleasing tobacco-like brown color to the inherently black cut filler. Cigarettes containing 10 parts by weight of the resulting coated cut filler and 90 parts by weight of a commercial blend of cut tobacco produce very satisfactory smoking characteristics and lower nicotine levels in the smoke when compared with cigarettes containing only the commercial blend of cut tobacco.

EXAMPLE 6

The procedure of Example 5 is repeated except that finely divided, toasted rice prepared by the procedure of Example 3 is used instead of toasted corn to coat the black cut filler with the tobacco-like brown toasted rice particles. Smoking of the cigarettes prepared with the coated cut filler provides results comparable to those of Example 5.

EXAMPLE 7

A cut filler (200 g.) prepared from pyrolyzed tobacco stems as described in Example 4 is sprayed with an aqueous solution comprising 70 grams of water and 2 grams of propylene glycol while the cut filler is tumbled in an inclined rotating drum. With continued tumbling of the moistened cut filler, 70 grams of finely divided, toasted corn prepared by the procedure of Example 2 is sprinkled onto the tumbling cut filler. The toasted corn is uniformly distributed on and adheres well to the surface of the cut filler to produce a cut filler having a very good tobacco-like brown color. A blend of 30 parts by weight of the coated cut filler and 70 parts by weight of cut tobacco is used for making cigarettes which exhibit acceptable smoking characteristics and reduced levels of nicotine in the smoke when compared with all tobacco cigarettes.

EXAMPLE 8

The procedure of Example 7 is repeated except that finely divided, toasted rice is used instead of toasted corn to produce a cut filler having a very good tobacco-like brown color. Smoking results with cigarettes containing this coated cut filler are similar to those containing the coated cut filler of Example 7.

What is claimed is:

1. A smoking product comprising a combustible smoking material coated with a quantity of finely divided, toasted cereal grain having a tobacco-like brown color, said quantity being sufficient to impart a tobacco-like brown color to said smoking material.

2. The smoking product of claim 1 wherein said finely divided, toasted cereal grain comprises particles having a maximum diameter of approximately 30 microns or less and said quantity is at least 20 percent by weight based on the dry weight of the smoking material.

3. The smoking product of claim 1 wherein said finely divided, toasted cereal grain is derived from a member of the group consisting of milo, corn, rice, wheat, millet, triticale, barley, oats and rye.

4. The smoking product of claim 2 wherein said combustible smoking material is derived from thermally degraded tobacco materials.

5. The smoking product of claim 2 wherein said combustible smoking material is derived from non-tobacco materials.

6. The smoking product of claim 1, 2, 3, 4 or 5 wherein said combustible smoking material is cut, shredded or otherwise comminuted.

7. The smoking product of claim 6 which is combined and blended with conventionally processed tobacco in proportions up to 50 percent by weight and said smoking product is in the form of a cigarette.

8. A process for imparting a tobacco-like brown color to a combustible smoking material which comprises treating the combustible smoking material with an aqueous medium containing a humectant agent to moisten the surface of said combustible smoking material and applying to the moistened surface of said combustible smoking material a quantity of finely divided, toasted cereal grain having a tobacco-like brown color, said quantity being sufficient to impart a tobacco-like brown color to said combustible smoking material.

9. The process of claim 8 wherein said finely divided, toasted cereal grain comprises particles having a maximum diameter of approximately 30 microns or less and said quantity is at least 20 percent by weight based on the dry weight of the smoking material.

10. The process of claim 9 wherein said finely divided, toasted cereal grain is derived from a member of the group consisting of milo, corn, rice, wheat, millet, triticale, barley, oats and rye.

11. The process of claim 9 wherein said combustible smoking material is derived from thermally degraded tobacco materials.

12. The process of claim 9 wherein said combustible smoking material is derived from non-tobacco materials.

13. The process of claim 8, 9, 10, 11 or 12 wherein said combustible smoking material is cut, shredded or otherwise comminuted prior to treatment with said aqueous medium.

14. The process of claim 13 wherein said aqueous medium also contains an adhesive agent.

15. A process for toasting an expanded or puffed cereal grain which comprises cutting, shredding or otherwise comminuting the expanded or puffed cereal grain to produce coarse particles of said grain and heating said coarse particles at temperatures of 190°–210° C. for a period of time sufficient to toast said particles and to cause said particles to develop a tobacco-like brown color.

16. The process of claim 15 wherein said expanded or puffed cereal grain is derived from a member of the group consisting of milo, corn, rice, wheat, millet, triticale, barley, oats and rye.

* * * * *